United States Patent [19]

Thomas

[11] Patent Number: 4,501,644

[45] Date of Patent: Feb. 26, 1985

[54] APPARATUS FOR THE SELECTIVE RETORTING OF CARBONACEOUS MATERIALS

[76] Inventor: Delbert D. Thomas, 1522 Cameo Dr., Redlands, Calif. 92373

[21] Appl. No.: 425,424

[22] Filed: Sep. 28, 1982

[51] Int. Cl.[3] ..... C10B 7/10; C10B 27/00; C10B 49/06; C10B 51/00

[52] U.S. Cl. ..... 202/99; 202/104; 202/108; 202/118; 202/134; 202/208

[58] Field of Search ..... 202/84, 85, 99, 104, 202/106, 108, 109, 114, 117, 118, 134, 137, 208, 215; 201/16, 29, 32, 33; 110/230, 276; 126/181

[56] References Cited

U.S. PATENT DOCUMENTS

| | | | |
|---|---|---|---|
| 847,676 | 3/1907 | MacKethan | 202/99 |
| 1,297,022 | 3/1919 | Shreves | 202/118 |
| 1,375,714 | 4/1921 | McLeod | 202/118 |
| 1,481,399 | 1/1924 | Webert | 202/118 |
| 1,490,213 | 4/1924 | Jenson | 202/118 |
| 1,510,045 | 9/1924 | Day | 202/87 |
| 1,538,796 | 5/1925 | Gorden | 202/118 |
| 1,556,894 | 10/1925 | Alcorn | 202/118 |
| 1,604,253 | 10/1926 | Barnhart | 202/118 |
| 1,656,107 | 1/1928 | Fairhall | 202/134 |
| 2,406,810 | 9/1946 | Day | 201/16 |
| 3,362,887 | 1/1968 | Rodgers | 202/117 |
| 3,644,193 | 2/1972 | Weggel et al. | 201/32 |
| 3,658,654 | 4/1972 | Gutberlet | 201/29 |
| 4,058,205 | 11/1977 | Reed | 201/16 |
| 4,235,676 | 11/1980 | Chambers | 202/114 |
| 4,258,005 | 3/1981 | Ito et al. | 201/31 |
| 4,308,103 | 12/1981 | Rotter | 201/33 |
| 4,398,998 | 8/1983 | Quame | 202/118 |

FOREIGN PATENT DOCUMENTS 2056033 3/1981 United Kingdom ..... 126/181

*Primary Examiner*—Bradley Garris

*Attorney, Agent, or Firm*—Poms, Smith, Lande & Rose

[57] ABSTRACT

A staged retort is provided for the retorting of certain types of carbonaceous materials such as oil shale, coal or lignite, wherein the staged retort includes a number of separate retort chambers arranged in a modular configuration, with one retort chamber above the other, and mounted transversely within the staged retort. Each retort chamber is heated to a different temperature, and carbonaceous material is moved from a given retort chamber to a retort chamber having a higher temperature, whereby heavier fractions of liquid and/or gaseous hydrocarbons are formed as the carbonaceous materials undergo pyrolysis. Arrangements such as pressure regulating valves are provided to reduce mixing of the various fractions between the individual retort chambers to nearly zero, and conduits are provided to separately withdraw the hydrocarbon gases and/or liquids from each retort chamber. The carbonaceous material leaving the last retort where the final pyrolysis reactions occur, is routed to a combustion compartment wherein it is burned to produce heat used to heat the retort chambers. The staged retort also includes arrangements for heating a predetermined portion of the gases formed in the retort chambers, to mix the heated portion with a predetermined unheated portion to arrive at a controlled temperature, and then to inject this controlled temperature gas and/or any other substances into the retort chamber interiors to control the temperatures and/or the reaction therein so that each retort chamber can be maintained at the proper temperature and conditions chosen for pyrolysis therein.

7 Claims, 13 Drawing Figures

APPARATUS FOR THE SELECTIVE RETORTING OF CARBONACEOUS MATERIALS

FIELD OF THE INVENTION

This invention relates in general to apparatus and methods for the multistage retorting of carbonaceous materials such as oil shale.

BACKGROUND OF THE INVENTION

Retorts for the pyrolysis of kerogen or other organic material found in carbonaceous materials such as oil shale, tar sands, coal and lignite, as presently designed, generally heat the carbonaceous materials to one temperature at which pyrolysis occurs, and the resulting liquid and/or gaseous products formed are then collected for processing. Alternative designs provide for heating the carbonaceous materials to different temperatures within the retort, but do not allow for the segregating of the products formed by pyrolysis at the varying temperatures. Therefore, in these retorts all fractions of hydrocarbons produced are allowed to mix with one another necessitating a costly fractionation procedure downstream. Furthermore, the temperatures in the different heating zones are not readily controllable, resulting in inefficient pyrolysis at the retort zone. The present invention is an apparatus and method for the selective retorting of hydrocarbon materials, which promotes efficient pyrolysis at varying temperatures and provides a means for separately withdrawing the liquid and/or gaseous products formed by pyrolysis so that fractionation downstream is simplified.

An example of a use to which the present invention could be put concerns the Devonian oil shales of the Eastern United States. Included within this class of shales are the New Albany shales of Indiana which in tests were seen to produce light gravity oil vapors when heated to approximately 350 degrees Fahrenheit, medium gravity oils at approximately 400 degrees Farenheit, a heavy gravity oil at approximately 550 degrees Fahrenheit, with an extremely heavy oil produced at 740 degrees Fahrenheit. Not only does this oil shale produce oil of four distinct fractions but produces more liquid hydrocarbon product and less gaseous product if the light fractions are removed from the retort chambers before allowing them to be exposed to the temperatures required to retort the heavier fractions. As a matter of interest, certain other types of carbonaecous material, such as Rocky Mountain Oil Shales, release oil at only one temperature range, about 900 degrees F. to 1100 degrees F.

Accordingly, the principal objects of the present invention are to provide a staged retort having multiple retort chambers sealed in such a way to prevent the mixing of liquid and/or gaseous products between them while at the same time permitting the passage of carbonaceous materials from a retort chamber of a lower temperature to a retort chamber of a higher temperature, and to provide means for separately withdrawing the products of pyrolysis formed in each retort chamber so that each of the fractions are kept separate.

SUMMARY OF THE INVENTION

In a broad aspect of the invention, a plurality of retort chambers are provided in which the carbonaceous solids and/or semisolids are heated, each retort chamber being maintained at a different predetermined temperature chosen to promote the most effective and efficient pyrolysis therein. Provision is made to separately withdraw the liquid and/or gaseous products formed by pyrolysis in each retort chamber. Means are provided for transporting the carbonaceous materials from a retort chamber of a given temperature to a retort chamber of a higher temperature so a subsequent pyrolysis can occur to produce a heavier oil fraction.

In accordance with another aspect of the invention, the carbonaceous solids and/or semisolids are continuously mixed within each retort chamber to provide approximately uniform heating of the carbonaceous materials, and are simultaneously conveyed through the retort chamber from its input end to its output end.

In accordance with a further aspect of the invention, said retort chambers are disposed in a modular arrangement one above the other, transversely mounted in an approximately vertical plane with a combustion compartment located below the lowest chamber where heated flue gases are produced and circulated upwardly in close proximity with the retort chamber walls, whereby the retort chamber closest to the combustion compartment is raised to the highest temperature, and the ascending retort chambers are raised to progressively lower temperatures as their distance from the combustion compartment increases.

In still another aspect of the invention, the mixing of the liquid and/or gaseous products between connecting retort chambers is limited to an acceptable minimum amount approaching zero.

Additionally, in order to accurately control the temperature within each retort chamber, arrangements are provided for injecting gas at a controlled temperature into one or more of the retort chamber interiors to influence the temperature therein so that each retort chamber is maintained at an individual predetermined temperature judged to produce the most efficient pyrolysis of the carbonaceous materials, to yield the chosen fractions of hydrocarbon products. Other materials, either gaseous, liquid or other transportable form may be added through the hollow tube to assist in nucleation of the liquid products, to assist in converting the carbonaceous materials into a gaseous hydrocarbon or to otherwise change the reaction within the retort chambers.

In one specific embodiment, a hollow shaft extends into each retort chamber, and this shaft has a plurality of apertures through which a controlled temperature gas is passed into the retort chamber interior.

In accordance with another aspect of the invention, a predetermined portion of the gaseous products formed by pyrolysis are preheated and the heated gas is then distributed to the injecting means located at each retort chamber.

In accordance with a still further aspect of the invention, the heated gas is mixed with a predetermined portion of unheated gas from one or more retort chambers whereby the temperature of the resultant mixture is controlled. The proportion is controlled by monitoring the temperature of each retort chamber, and choosing the correct proportions of unheated and heated gas to result in a mixture having a temperature which will correctly influence each retort chamber interior to its desired predetermined temperature.

The carbonaceous solids and/or semisolids are introduced into a first retort chamber located at the top of the modular arrangement through a means for limiting the escape of liquid and/or gaseous products from the first retort chamber. After remaining in the first retort chamber for a predetermined time to allow pyrolysis at that temperature to be completed, means are provided for transporting the carbonaceous materials to a subsequent retort chamber having a higher temperature, and thereafter successively feeding the carbonaceous material to progressively hotter retort chambers.

A holding chamber is provided at the input of the first retort chamber, and is sealed by gates to prevent the escape of vapors from the retort chamber into the atmosphere. The holding chamber may be purged by steam before being opened to the atmosphere, and the hydrocarbon products of pyrolysis reclaimed from the resulting mixture.

Additionally, carbonaceous materials leaving the last retort chamber are routed to a combustion chamber at the bottom of the staged retort where they are burned to produce heat which is circulated upwardly to contact the walls of the individual retort chambers.

The modular structure of the staged retort allows for the addition of heat exchangers to heat the gas used for injection into the retort chamber interiors to influence their temperatures, heat exchangers to produce hot water or steam for use in the retorting or related processes, and heat exchangers to heat oil prior to fractionation.

It may be noted in passing that the present retort assembly utilizes at least three modes of heat transfer: (1) Radiant energy, through infrared radiation, (2) Convection, or gas to solid heat exchange, and (3) Conduction, or heated surface to solid material exchange.

Other objects, features, and advantages of the present invention will become apparent to those skilled in the art, from a consideration of the following detailed description of a preferred embodiment and the accompanying drawings.

DETAILED DESCRIPTION

Figure 1:
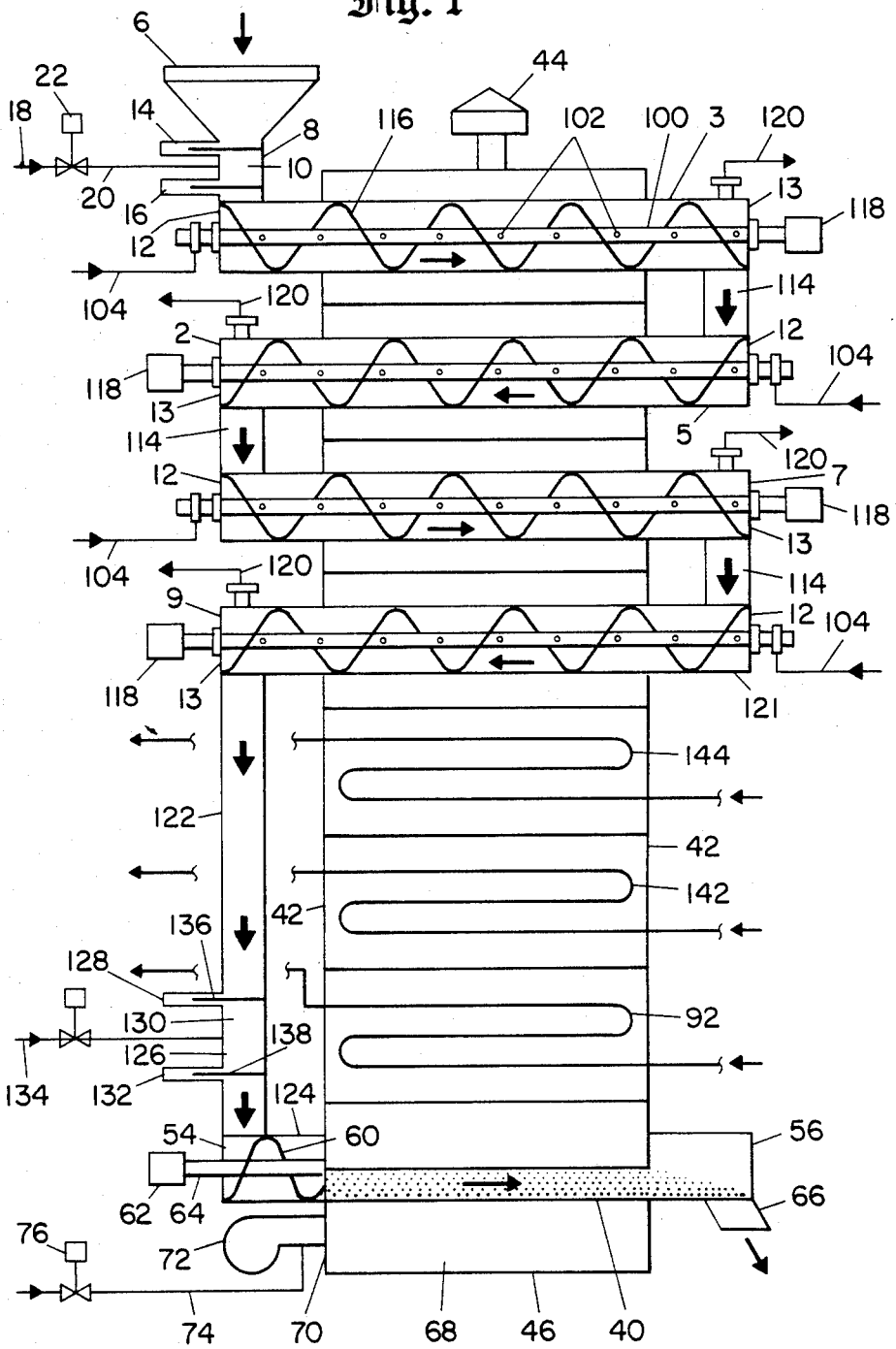
FIG. 1 is a cut-away schematic of a staged retort showing four (4) retort chambers and other major components of a retort illustrating the principles of the invention.

A preferred embodiment of a staged retort for removing liquid and/or gaseous products from carbonaceous solids and/or semisolids is shown in FIGS. 1–13. A plurality of retort chambers 3, 5, 7 and 9 transversely mounted in a modular arrangement are shown in FIG. 1. The carbonaceous materials such as oil shale, oil sands, tar sands, gilsonite, lignites, and coals are heated in each retort chamber, and the pyrolysis reaction occurs therein.

The first retort chamber 3 is located at the top of the staged retort of FIG. 1, and is the chamber in which the first pyrolysis occurs. Carbonaceous material is introduced into the first retort chamber 3 through a hopper 6 which is kept filled assuring a steady supply of carbonaceous materials for the first retort chamber 3. The pressure within first retort chamber 3 is greater than the atmospheric pressure, which is caused by the pyrolysis of the carbonaceous material within, and the resultant formation of vapors. As the first retort 3 is opened to receive carbonaceous material, these pressurized vapors tend to escape into the atmosphere causing environmental pollution and the loss of valuable hydrocarbon products. To prevent this loss, a means for limiting escape 8 is employed to block their escape into the atmosphere, and to limit losses from the first retort chamber 3.

The means for limiting escape 8 includes a holding chamber 10 situated immediately below the hopper 6 and above the input end 12 of the first retort chamber 3. The carbonaceous materials pass by gravity from the hopper 6 through the holding chamber 10 and into the input end 12 of the first retort chamber 3. A first gate 14 is located between the hopper 6 and the holding chamber 10. The first gate 14 is opened to allow a predetermined quantity of carbonaceous material to pass from the hopper 6 into the holding chamber 10. It is thereafter closed and a second gate 16 at the bottom of holding chamber 10 is opened to allow the carbonaceous material to pass into the input end 12 of the first retort chamber 3. As the second gate 16 is opened and the carbonaceous material empties into the first retort chamber 3, vapors within the first retort chamber 3 enter holding chamber 10. The second gate 16 is then closed, and prior to opening first gate 14, the holding chamber 10 is purged of the gases confined therein. A means for purging 18 is employed, and in the preferred embodiment includes a steam line 20 through which steam is passed into and through the holding chamber 10. Steam line 20 is controlled by a purge valve 22. The resultant mixture of hydrocarbon gases, liquids and steam can be separated if desired and the hydrocarbons recovered.

Figure 6:
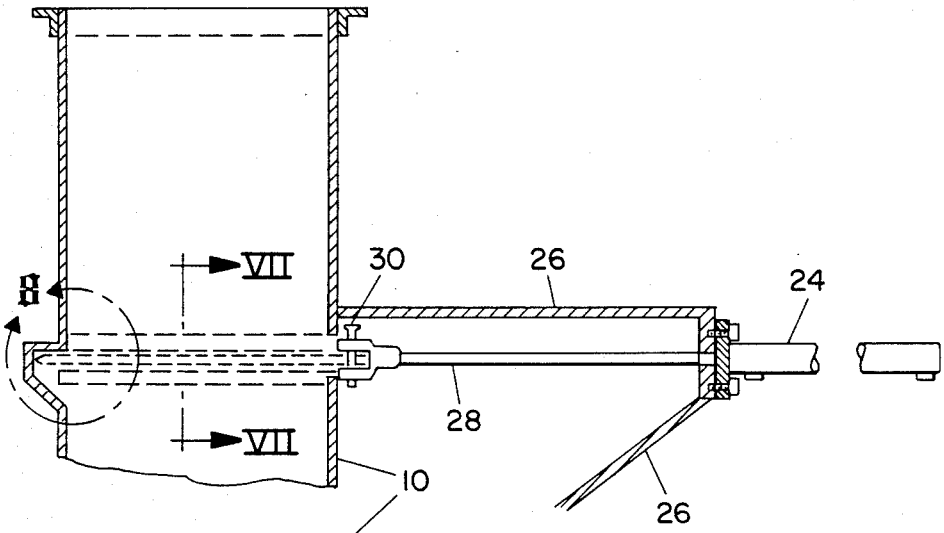
FIG. 6 is a side view of a gate into a holding chamber in which carbonaceous solids and/or semisolids are deposited.
Figure 7:
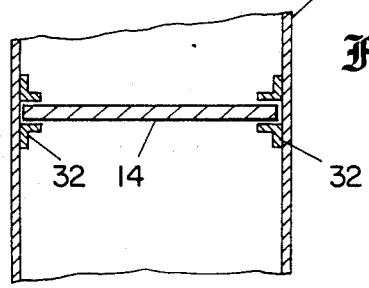
FIG. 7 is a section view taken along the plane VII—VII of FIG. 6.
Figure 8:
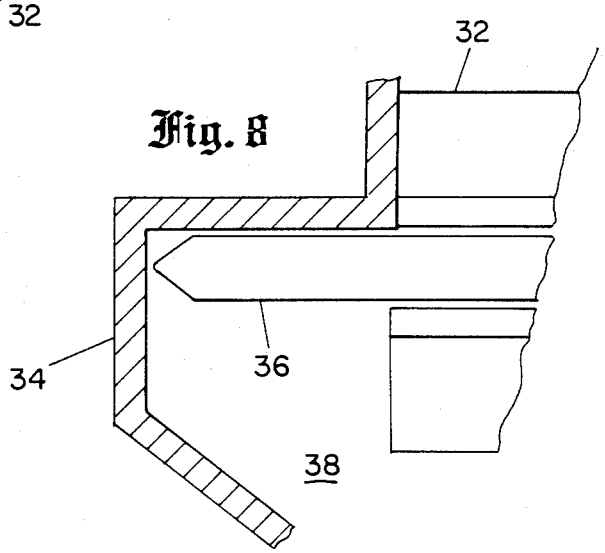
FIG. 8 is a detailed view of a specified portion of FIG. 6.

The first gate 14 may be implemented as shown in FIG. 6 by a pressure operated baffle. A hydraulic cylinder 24 and a piston therein (not shown) move the gate back and forth as desired. The hydraulic cylinder 24 may be supported by frame members 26, which also support the first gate 14 when in its open position. FIG. 6 depicts the first gate 14 in a closed position. The gate 14 is pulled open or pushed closed by rod 28 attached to the gate by a pin 30, which may also be any other suitable means for fastening such as a bolt or rivet. The gate 14 moves within guides 32 located on each side of holding chamber 10, and can clearly be seen in FIG. 7. FIG. 8 shows a detailed view of the end of gate 14 which rests in a recess 34 in the holding chamber 10, in its closed position. The tolerance in gap 36 is chosen to limit the escape of pressurized gases into the atmosphere, while at the same time providing sufficient clearance for the gate 14. The end of gate 14 is a chisel point in the preferred embodiment, to facilitate its moving through a body of coarse carbonaceous material as may be present when retorting oilshale. A passage 38 is provided to allow carbonaceous materials which have been pushed into the recess 34 by the end of gate 14 to fall into the holding chamber 10 and not create a build-up in the recess 34.

The second gate 16 may be similarly constructed and may employ a hydraulic cylinder and other similar structure to perform the same functions as discussed above relative to the first gate 14.

Each retort chamber is raised to a different temperature so that the pyrolysis reaction in each produces gaseous and/or liquid products having different weights or viscosities. In the case of the new Albany shales of Indiana, tests have shown that light gravity oil vapors are produced at 350 degrees Fahrenheit, medium gravity oils are produced at 400 degrees Fahrenheit, a heavy gravity oil is produced at 550 degrees Fahrenheit, with an extremely heavy oil produced at 740 degrees Fahrenheit. Not only does this oil shale produce oil of four (4) distinct fractions, but produces more liquid hydrocarbon products and fewer gaseous products if the light fractions are removed from the retort chambers before allowing them to be exposed to the temperatures required to pyrolyze the heavier fractions. Therefore, in the preferred embodiment of this invention, the plurality of retort chambers 3, 5, 7 and 9 is arranged in such a way that the first retort chamber 3 is heated to the lowest temperature of any of the other retort chambers, so that the light gravity oil vapors are produced therein, at the approximate temperature of 350 degrees Fahrenheit. The successive retort chambers 5, 7 and 9 are arranged such that each successive chamber is heated to a higher temperature whereby successively heavier gravity oils are produced in each.

In the preferred embodiment, the means for heating the retort chambers includes a dual procedure involving the burning of carbonaceous material at the bottom of the staged retort to produce heat, and also the injection of controlled temperature gas into the interiors of the retort chambers to influence the temperature in each retort chamber to its correct predetermined temperature, to cause an efficient pyrolysis reaction.

Figure 3:
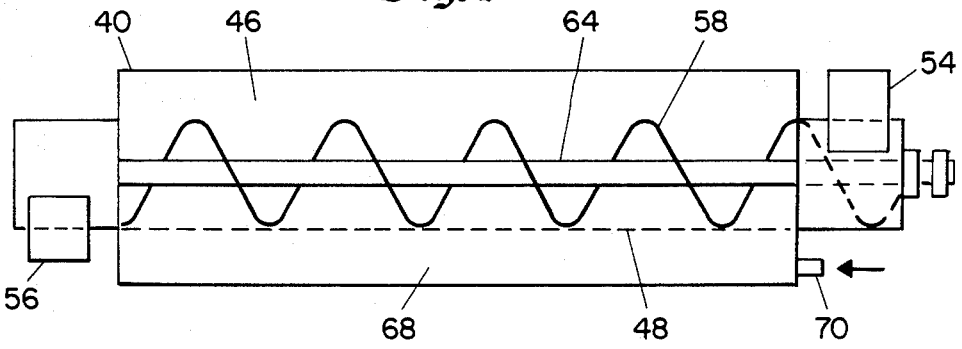
FIG. 3 is a side view of a combustion compartment in which carbonaceous materials are burned to provide heat for the staged retort.
Figure 4:
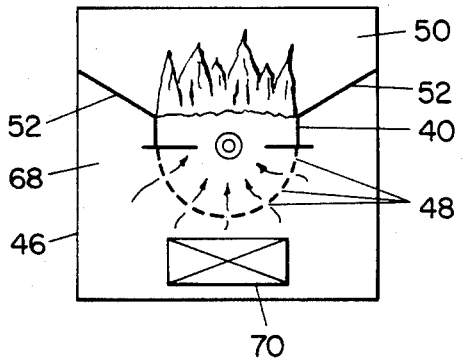
FIG. 4 is an end view of the combustion compartment showing one embodiment of the combustion tube.
Figure 5:
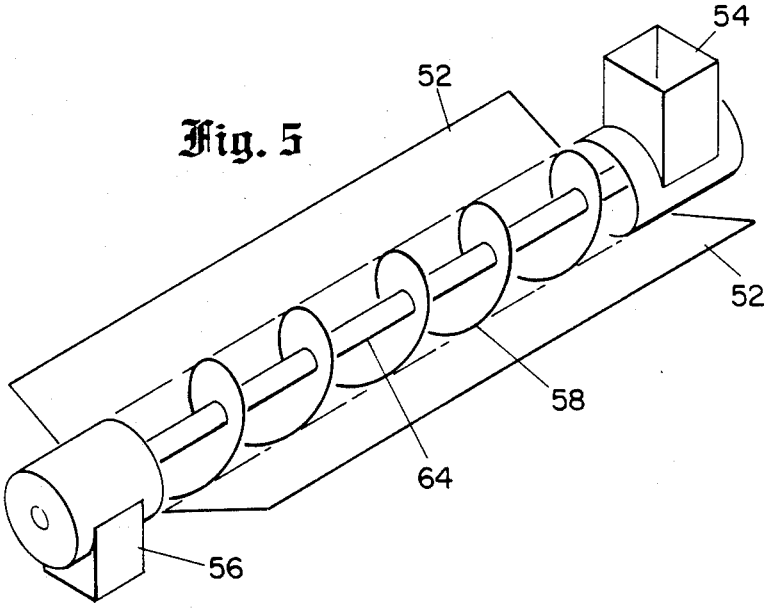
FIG. 5 is a perspective view of one embodiment of a combustion tube.

In the preferred embodiment, a means for burning carbonaceous material is shown in FIG. 1 as combustion tube 40. The heat produced in the form of flue gas rises upwardly and is contained within the staged retort by walls 42. As heat is absorbed by the successive retort chambers and heat exchangers as discussed below, the temperature of the flue gas decreases, and each higher elevation retort chamber is maintained at a lower temperature than the physically lower retort chambers. The flue gas eventually exits from the staged retort through a flue cap 44. The combustion tube 40 is located within a heating chamber or combustion compartment 46 which can be seen in FIGS. 1, 3 and 4. The carbonaceous material which is introduced into the combustion tube 40 is the carbonaceous residue remaining from the last retort chamber located above it. The residue is very hot, and when exposed to an oxygen carrying gas, burns to produce a significant amount of heat. The combustion tube 40 is provided with one or more lower apertures 48 through which the oxygen carrying gas enters and contacts the carbonaceous residue. The combustion tube 40 is also provided with one or more upper apertures 50 through which the hot flue gas created by combustion exits and circulates upwardly in close proximity to the retort chamber walls. In the preferred embodiment, the combustion tube has one upper aperture 50 running for nearly its entire length so that it is open at the top to facilitate a quick and complete burning of the flammable materials remaining in the carbonaceous residue. The open upper zone 50 can best be seen in FIGS. 4 and 5. A divider 52 sealed to the inside of the combustion compartment wall prevents oxygen carrying gas from bypassing the combustion tube, and forces flow through the lower apertures 48 in the combustion tube. In the preferred embodiment, a means is provided to move the carbonaceous residue through the combustion tube from its input end 54 to its output end 56. In FIGS. 3 and 5 the means for moving the carbonaceous residue through the combustion tube 40 is shown as a screw-type conveyer 58 which not only moves the material along, but also continually mixes it to expose all the particles to the oxygen carrying gas so that burning is complete.

An alternative to the screw-type conveyer 58 depicted in FIGS. 3 and 5 is the shortened screw type conveyor 60 shown in FIG. 1. The shortened screw 60 does not extend beyond the exterior wall 42 and is not exposed to the heat generated by the burning carbonaceous residue. A drive motor 62 rotates the conveyor shaft 64, and, as additional material is forced into the combustion tube, the partially burned carbonaceous material is pushed along. Means for removing the burned residue of the carbonaceous material pushed through the combustion tube are provided by the discharge chute 66 shown in FIG. 1. A plenum chamber 68 is located within the combustion compartment 46, below combustion tube 40 and sealed by plates 52 to the combustion tube and the retort assembly walls so that as an oxygen carrying gas is injected under pressure into the plenum chamber 68 through inlet 70, the oxygen carrying gas will (which may be air) pass through lower apertures 48. Means for inserting the oxygen carrying gas into the plenum chamber 68 are provided by blower 72, delivery line 74 and metering valve 76. Blower 72 can serve another function in conjunction with flue cap 44 as a means for circulating the flue gases upwardly to contact the retort chamber walls.

The second method for affecting the temperatures and reactions within the retort chamber interiors includes a means for injecting gas at a controlled temperature into the interiors of all, or selected ones, of the retort chambers to influence the temperature within the retort chambers so that each retort chamber interior is maintained at its individual predetermined temperature.

Figure 2:
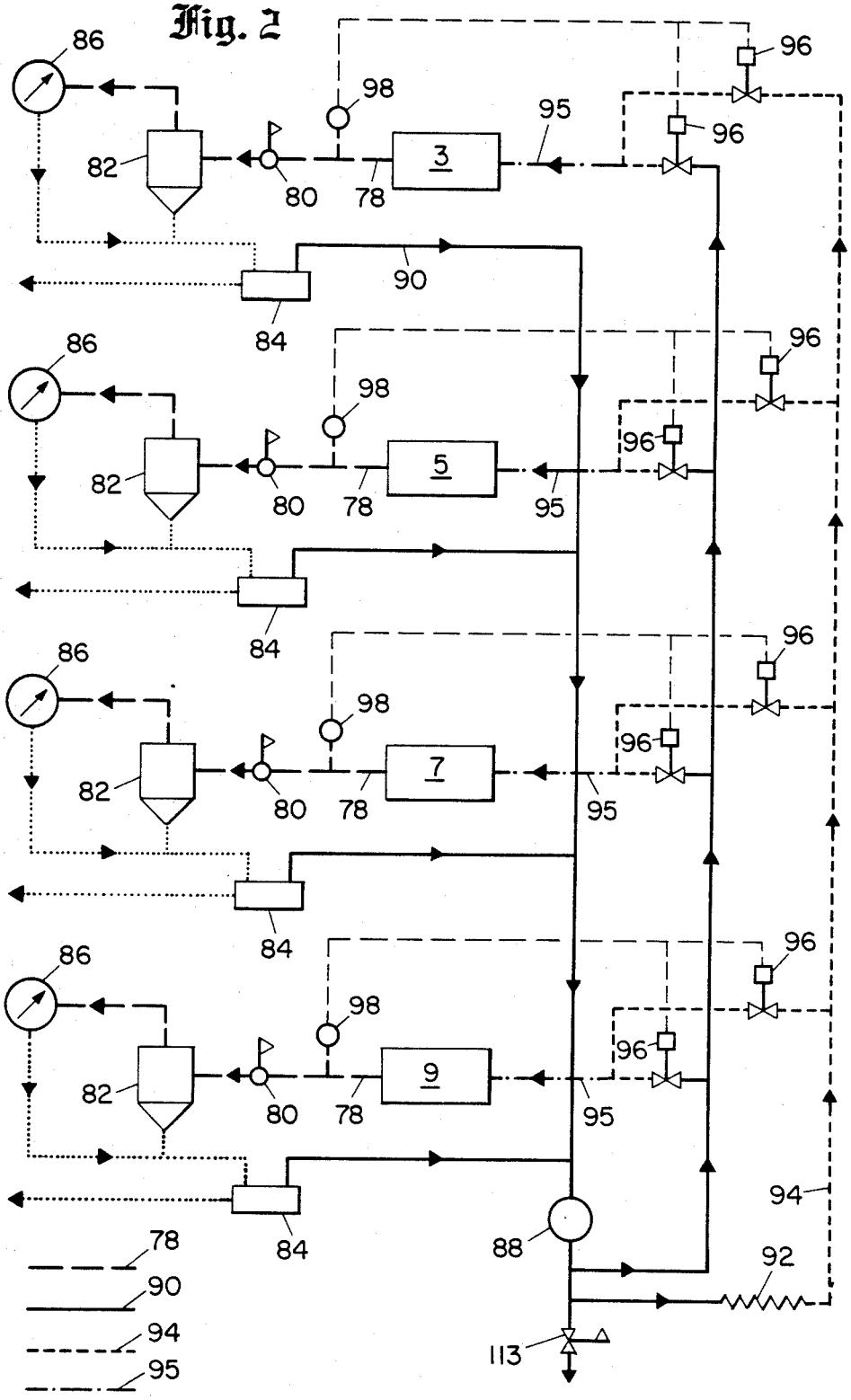
FIG. 2 is a schematic diagram of a system for recovering the liquid and/or gaseous products of pyrolysis occurring in the individual retort chambers, and also shows a gas recycling system employed to heat the individual retort chambers.

This means for injecting gas is comprised of a number of elements including a means for recycling a predetermined portion of the gaseous products of pyrolysis from one or more of the retort chambers. This means for recycling is shown in FIG. 2. The retort chambers 3, 5, 7 and 9 shown in FIG. 1 are depicted as blocks, the upper most block representing first retort chamber 3. Hot oil and gas vapors produced by pyrolysis are discharged from the retort chambers along discharge lines represented by the long dash lines 78. The temperature of the products in discharge lines 78 is relatively hot having just exited the various retort chambers. The products pass through pressure regulators 80 which maintain the pressure in the respective retort chambers at an optimum predetermined pressure. The products pass through separators 82 which separate the majority of the heavier oil fractions and pass them into receiver/-transfer pumps 84 which send the product to storage or for further down stream processing. The uncondensed vapors pass to condensors 86 where they are cooled, and the remainder of the vapors are condensed and passed through the receiver/transfer pumps 84. The remaining cooled gases are withdrawn from the receiver/transfer pumps 84 by a blower 88 which also serves as a means for pressurizing the system. The solid lines 90 indicate the path of this cooled gas.

A portion of this cooled gas is routed through a means for raising its temperature, which in the preferred embodiment is a gas heat exchanger 92 which is located in the staged retort itself above the combustion chamber 68, as can be seen in FIG. 1. The path of the heated gas is depicted in FIG. 2 along the short dashed lines 94.

A means for monitoring temperature, which in FIG. 2 is a thermostat 98 located at the output of each retort chamber, monitors the internal temperature of each retort chamber, and feeds information back to tempering valves 96 located in the hot and cool gas lines which controllably mix the gas. The thermostats 98 are preset to the desired temperature for each retort chamber, and the tempering valves choose a mixture which provides a temperature to correctly influence the internal temperature of each retort chamber to its correct predetermined temperature. The controlled temperature gas travels along dash-dot paths 95 in FIG. 2, and is then injected into each retort chamber through a hollow shaft 100 (see FIGS. 1 and 9) extending through each retort chamber, and supported by bearings at each end. The gas passes through apertures 102 in the hollow shaft into the interior of the retort chamber. As gas is produced by pyrolysis in the retort chambers, beyond what is required to be injected back into the retort chambers to control the temperatures therein, pressure in the system rises, and at a predetermined level is released for processing through relief valve 113.

Figure 9:
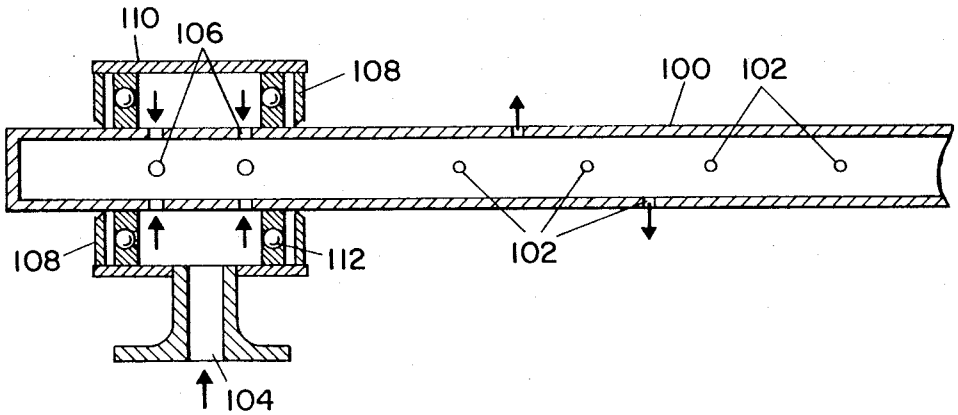
FIG. 9 is a side view of a hollow shaft through which controlled temperature gas and/or other substances is injected into a retort chamber interior to influence the temperature and reaction therein.

FIG. 9 shows a detail of the inlet side of the hollow shaft 100. Gas enters the hollow shaft 100 through gas inlet port 104 and passes through inlet ports 106 into the hollow shaft 100 itself. Seals 108 prevent the escape of gas from inlet gland 110 and force it into the hollow shaft 100. A bearing 112 supports the hollow shaft 100 so that it may rotate with respect to the inlet gland 110. This rotation function is explained later below.

Means are provided for transporting the carbonaceous solids and/or semi-solids from a retort chamber of a given temperature to a retort chamber of a higher temperature thereby successively feeding the multiple retort chambers. In the preferred embodiment this is accomplished quite simply by allowing the material to descend by gravity through downcomers 114. In FIG. 1 downcomers 114 are depicted between the four retort chambers connecting the output end 13 of a given retort chamber to with the input end 12 of the subsequent chamber. Each means for transporting includes means for limiting the mixing of liquid and/or gaseous product between the connecting retort chambers during each transfer process, to a predetermined acceptable level. This may be accomplished by a device such as the means for limiting escape 8 depicted at the top of FIG. 1, or by a rotary compartmentalized mechanism similar to a paddle wheel allowing continuous feeding of carbonaceous material from one chamber to the next, or any other suitable means to limit the mixing of the products of pyrolysis in each retort chamber.

Whereas a physical separation is referenced, to prevent the mixing of liquid and/or gaseous products, the purpose of pressure regulator 80 is to maintain equal pressure in all retort chambers so that gaseous and/or liquid products will leave their respective retort chamber through outlet port 120 rather than through downcommer 114. Flow is induced through outlet port 120 due to a decrease in pressure at outlet 120 created by blower 88.

Means are provided in the staged retort for mixing the carbonaceous solids and/or semi-solids within each retort chamber to provide substantially uniform and complete heating of all of the materials within the retort chamber. In the preferred embodiment depicted in FIG. 1, the means for mixing is a rotatable helical screw conveyor 116 which simultaneously provides the means for conveying the carbonaceous solids and/or semi-solids through the retort chamber from its input end 12 to its output end 13. The helical flights are attached to the hollow shaft 100 and are rotated by gear motors 118 or any other suitable drive mechanism.

Means are provided for separately withdrawing the liquid and/or gaseous products formed by pyrolysis in each retort chamber by outlet ports 120 through which the products of pyrolysis pass through the pressure regulators 80 shown in FIG. 2, into separators 82, condensers 86, and the receiver/transfer pumps 84.

Spent carbonaceous materials which have undergone pyrolysis for the final time are expelled from the last retort chamber 121 and descend by gravity through coke chute 122 into a coke feed tube 124 to be conveyed into the combustion tube 40 by screw type conveyors 58 or 60. In FIG. 1, a second means for limiting the escape of liquid and/or gaseous products of pyrolysis from the last retort chamber as spent carbonaceous materials are removed therefrom, is shown at number 126. Its function is essentially the same as the first means for limiting escape 8 located above the uppermost retort chamber, and is comprised of an entry gate 128 to a second holding chamber 130, an exit gate 132, and a second means for purging 134 by which steam is injected into the second holding chamber 130 to purge it of liquid and/or gaseous products of pyrolysis. The entry gate 128 includes a third pressure operated baffle 136, and the exit gate 132 includes a fourth pressure operated baffle 138 which function similarly to first gate 14 and second gate 16.

Discharge chute 66 provides a means for disposing of spent material, comprising primarily shale ash, from the staged retort after burning in the combustion tube 40.

Because of the modular construction of the staged retort, it is possible to add as many retort chambers as deemed necessary to obtain any number of fractions from the carbonaceous solids and/or semisolids as the materials may lend themselves to. It is also possible to add heat exchangers within the retort walls 42 below the lower most retort chamber 9 and above the combustion compartment 46, to take advantage of the heat generated by the burning of the carbonaceous residue in combustion tube 40. Shown in FIG. 1 is a means for heating water 142 wherein the water may be heated to produce either hot water or steam for use in the retorting or related processes, as for example in the means for purging 18 and the second means for purging 134. A means for heating oil 144 may also be added wherein the oil is heated as a preparatory operation within a refining process prior to fractionation. Depicted in FIG. 1 is the gas heat exchanger 92 which is used to heat a portion of the gas produced by pyrolysis in the various retort chambers, for injecting back into the retort chambers through the hollow shafts 100, to influence the temperature of each retort chamber interior.

Figure 10:
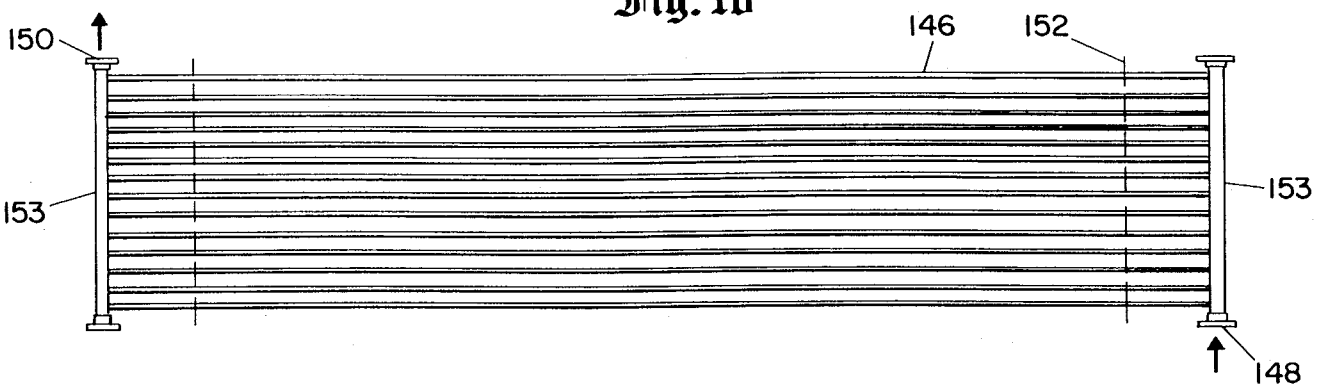
FIG. 10 is a top view of a heat exchanger module located within the staged retort.
Figure 11:
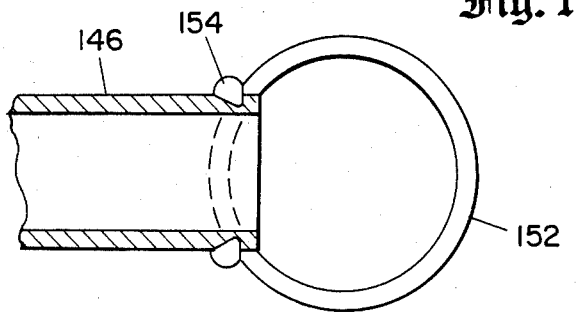
FIG. 11 is a top view of a heat exchanger tube attached to a header.

A heat exchanger module is depicted in FIG. 10. The substance to be heated is injected at inlet 148, moves through heating tubes 146 and exits at outlet 150. The dashed lines 152 represent the walls of the retort itself which are sealed to the heating tubes 146 to prevent the loss of heat from the retort into the atmosphere. FIG. 11 shows a heating tube 146 attached to a header 153 by welds 154.

Figure 12:
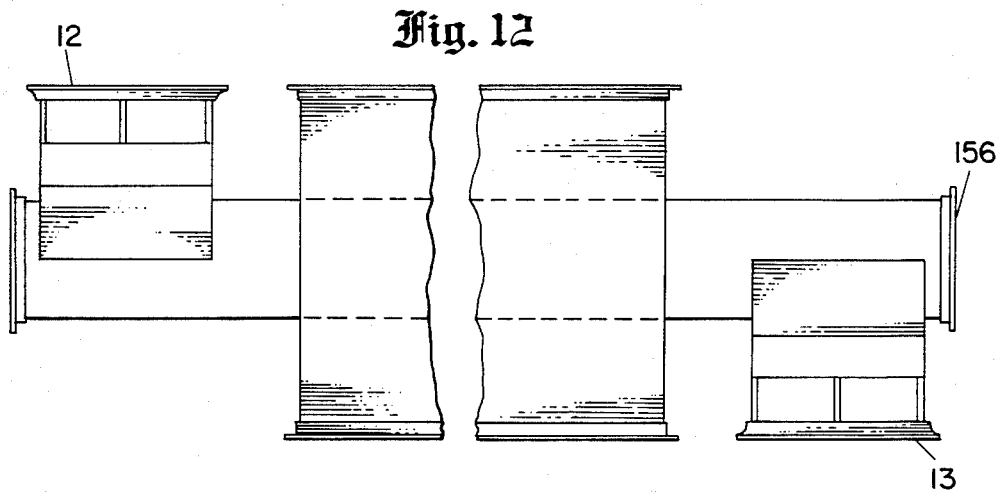
FIG. 12 is a side view of a retort chamber casing showing its input and output means.
Figure 13:
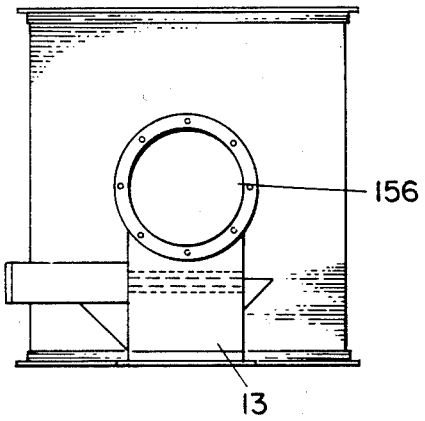
FIG. 13 is an end view of FIG. 12.

FIG. 12 shows a typical retort chamber and its input end 12 and output end 13. A hollow shaft 100 as discussed previously, is inserted through opening 156 and passes completely through the retort chamber interior.

Incidentally, Devonian oil shale, as mentioned above, produces hydrocarbon products of different weights or viscosities at certain temperatures. Accordingly, if this shale were processed in the disclosed preferred embodiment, retort chamber 3 would be heated to approximately 350 degrees Fahrenheit to produce a light gravity oil, retort chamber 5 would be heated to approximately 400 degrees Fahrenheit at which temperature a medium gravity oil would be produced, retort chamber 7 would be heated to approximately 550 degrees Fahrenheit to produce a heavy gravity oil, and chamber retort chamber 9 would be heated to approximately 740 degrees Fahrenheit to produce an extremely heavy oil.

Another example of a particular use of the present invention is the retorting of certain oil sands from Wyoming. In this case, retort chamber 3 would be heated to approximately 300 degrees Fahrenheit to produce a light fraction of hydrocarbons, and retort chamber 5 would be at approximately 550 degrees Fahrenheit to produce a heavy product. Retort chamber 7 and 9 would be removed or bypassed, as only two fractions would be produced.

At third example is tar sand from Utah. Here retort chamber 3 would be at approximately 390 degrees Fahrenheit wherein a light fraction would be produced, retort chamber 5 would be at approximately 550 degrees Fahrenheit to produce a medium fraction, and retort chamber 7 would be at approximately 700 degrees Fahrenheit to produce a heavy fraction. Retort chamber 9 would then be eliminated or bypassed in a staged retort processing such material.

Other materials, either gaseous, liquid or other transportable form may be added through the hollow tube to assist in nucleation of the liquid products, to assist in converting the carbonaceous materials into a gaseous hydrocarbon or to otherwise change the reaction within the retort chambers. Examples: (1) Hydrogenation of the liquid or gaseous product; and (2) salt vapors could also be added to allow oil to nucleate around a salt crystal to assist in liquid deposition.

It is to be understood that the disclosed apparatus is merely illustrative of the principles of the present invention which could be implemented by other types of structures. For example, the individual retort chambers could be situated at an slight downward angle to the horizontal from left to right to facilitate movement of the carbonaceous materials within, and the screw type conveyor could be replaced by a linear moving surface on which the carbonaceous material rests. Accordingly, the scope of the present invention is to be determined in accordance with the appended claims.

What is claimed:

1. A staged retort for removing liquid and/or gaseous products from carbonaceous solids and/or semisolids such as oil shale comprising:

a plurality of retort chambers in which the carbonaceous solids and/or semisolids are heated, each said chamber including enclosing walls separating the interior of each said retort chamber from the exterior thereof;

means for heating each retort chamber to a different temperature;

said plurality of retort chambers including a first retort chamber into which the carbonaceous solids and/or semisolids are first introduced into the staged retort;

means for introducing the carbonaceous solids and/or semisolids into the first retort chamber;

means for limiting escape of the liquid and/or gaseous products from the first retort chamber as carbonaceous solids and/or semisolids are introduced therein;

means for transporting the carbonaceous solids and/or semisolids from a retort chamber of a given temperature to a retort chamber of a higher temperature;

means for separately withdrawing the liquid and/or gaseous products formed by pyrolysis in each retort chamber;

the plurality of retort chambers including a last retort chamber in which the carbonaceous solids and/or semisolids are pyrolyzed for the last time;

second means for limiting escape of the liquid and/or gaseous products from the last retort chamber as spent carbonaceous materials are removed therefrom;

means for burning the carbonaceous materials from the last retort chamber to produce heat for heating the retort chambers;

means for raising the temperature of a gas;

means for recycling a predetermined portion of the gaseous products of pyrolysis from one or more retort chambers into the means for raising gas temperature to obtain a heated gas;

means for controlling the temperature of the recycled gas;

means for monitoring the temperatures of each of the retort chamber interiors so that the required temperature of the controlled temperature gas can be determined to correctly influence each chamber interior to a predetermined temperature;

means for injecting the controlled temperature gas into one or more retort chamber interiors to influence the temperature therein, so that each retort chamber interior is maintained at its individual predetermined temperature;

said retort chambers disposed in a modular arrangement one above the other;

a combustion compartment enclosing the means for burning located below the lowest retort chamber in which heated flue gases are produced;

means for circulating the heated flue gases upward in close proximity to the retort chamber walls whereby the retort chamber closest to the combustion compartment is raised to the highest temperature, and the ascending retort chambers are raised to progressively lower temperatures as their distance from the combustion compartment increases; and means for disposing of spent material from the staged retort.

2. A staged retort for removing liquid and/or gaseous products from carbonaceous solids and/or semisolids comprising:

a plurality of retort chambers in which the carbonaceous solids and/or semisolids are heated, each said chamber including enclosing walls separating the interior of each said retort chamber from the exterior thereof;

said retort chambers disposed in a modular arrangement one above the other;

a combustion compartment located below the lowest chamber in which heated flue gases are produced;

means for circulating the heated flue gases upward in close proximity to the retort chamber walls whereby the retort chamber closest to the combustion compartment is raised to the highest temperature, and the ascending retort chambers are raised to progressively lower temperatures as their distance from the combustion compartment increases;

a combustion tube within the combustion compartment into which heated carbonaceous material is introduced;

said combustion tube having one or more lower apertures on its underside through which an oxygen carrying gas is passed causing combustion of the heated carbonaceous material;

said combustion tube having one or more upper apertures or openings through which hot flue gases created by combustion exit;

means for removing the burned residue of carbonaceous material from the combustion tube;

a plenum chamber below the combustion tube and sealed thereto so that the oxygen carrying gas must pass through the lower apertures of the combustion tube;

means for introducing the oxygen carrying gas into the plenum chamber;

means for mixing the carbonaceous solids and/or semisolids within each retort chamber to provide substantially uniform and complete heating of the materials within the retort chamber;

an input end in each retort chamber into which the carbonaceous solids and/or semisolids are introduced;

an output end in each retort chamber from which the carbonaceous solids and/or semisolids are removed;

means for conveying the carbonaceous solids and/or semisolids through the retort chamber from its input end to its output end;

means for limiting the mixing of gases between the retort chambers to a predetermined acceptable level;

a hollow shaft extending into each retort chamber and having a plurality of apertures through which gas at a controlled temperature is introduced into one or more retort chamber interiors to influence the temperature therein, so that each retort chamber interior is maintained at a predetermined temperature;

said plurality of retort chambers including a first retort chamber into which the carbonaceous solids and/or semisolids are first introduced into the staged retort;

a holding chamber for holding carbonaceous solids and/or semisolids prior to introduction into the first retort chamber;

a first gate to the holding chamber which is opened to allow carbonaceous solids and/or semisolids to enter the holding chamber, and which is closed after a predetermined amount of carbonaceous solids and/or semisolids are within the holding chamber;

a second gate from the holding chamber which is opened to allow carbonaceous solids and/or semisolids to pass from the holding chamber on their way to the first retort chamber;

means for purging the holding chamber of gaseous products prior to the opening of the first gate thereof;

said plurality of retort chambers including a last retort chamber in which the carbonaceous solids and/or semisolids are pyrolyzed for the final time;

a second holding chamber for holding carbonaceous materials at the output end of the last retort chamber;

an entry gate to the second holding chamber which is opened to allow carbonaceous materials to enter the second holding chamber, and which is closed after a predetermined amount of carbonaceous material is within the second holding chamber;

an exit gate from the second holding chamber which is opened to allow carbonaceous materials to pass from the second holding chamber;

second means for purging the second holding chamber of gaseous products prior to the opening of the exit gate to prevent the escape of the gaseous products;

means for burning the carbonaceous material remaining in the last retort chamber after pyrolysis therein to produce heat for heating the retort chambers;

means for separately withdrawing the liquid and/or gaseous products of pyrolysis in each retort chamber;

a gas heat exchanger within the staged retort through which gas flows whereby its temperature is raised;

means for recycling a predetermined portion of the gaseous products of pyrolysis from one or more retort chambers into the gas heat exchanger;

means for controllably mixing the heated gas produced in the gas heat exchanger with a predetermined portion of the unheated gaseous products of pyrolysis from one or more retort chambers whereby the temperature of the resulting gas mixture can be controlled;

means for injecting the controlled temperature gas into the hollow shaft in one or more retort chamber interiors; and, means for monitoring the temperatures of each of the retort chamber interiors so that the required temperature of the resulting mixture of heated and unheated gas can be determined to correctly influence each chamber interior to its predetermined temperature.

3. The staged retort of claim 2 wherein the means for limiting includes:

equal pressure maintaining means for maintaining approximately equal pressure in all retort chambers; and means for decreasing pressure in the means for separately withdrawing pyrolysis products, to a pressure less than the pressure in each corresponding retort chamber, for inducing flow of the pyrolysis products through the means for separately withdrawing and for limiting the mixing of pyrolysis products between the retort chambers.

4. A staged retort for removing liquid and/or gaseous products from carbonaceous solids and/or semisolids such as oil shale comprising:

a plurality of retort chambers in which the carbonaceous solids and/or semisolids are heated, each said chamber including enclosing walls separating the interior of each said retort chamber from the exterior thereof;

means for heating each retort chamber to a different temperature;

said plurality of retort chambers including a first retort chamber into which the carbonaceous solids and/or semisolids are first introduced into the staged retort;

means for introducing the carbonaceous solids and/or semisolids into the first retort chamber;

means for limiting escape of the liquid and/or gaseous products from the first retort chamber as carbonaceous solids and/or semisolids are introduced therein;

means for transporting the carbonaceous solids and/or semisolids from a retort chamber of a given temperature to a retort chamber of a higher temperature;

means for separately withdrawing the liquid and/or gaseous products formed by pyrolysis in each retort chamber;

the plurality of retort chambers including a last retort chamber in which the carbonaceous solids and/or semisolids are pyrolyzed for the last time;

second means for limiting escape of the liquid and/or gaseous products from the last retort chamber as spent carbonaceous materials are removed therefrom;

means for burning the carbonaceous materials from the last retort chamber to produce heat for heating the retort chambers;

means for raising the temperature of a gas;

means for recycling a predetermined portion of the gaseous products of pyrolysis from one or more retort chambers into the means for raising gas temperature to obtain a heated gas;

means for controllably mixing the heated gas with a predetermined portion of the unheated gaseous products of pyrolysis from one or more retort chambers whereby the temperature of the resultant gas mixture can be controlled;

means for monitoring the temperatures of each of the retort chamber interiors so that the required temperature of the resultant mixture of heated and unheated gas can be determined to correctly influence each chamber interior to its predetermined temperature;

means for injecting said resultant gas mixture into one or more retort chamber interiors to influence the temperature therein, so that each retort chamber interior is maintained at an individual predetermined temperature;

said retort chambers disposed in a modular arrangement one above the other;

a combustion compartment enclosing the means for burning located below the lowest retort chamber in which heated flue gases are produced;

means for circulating the heated flue gases upward in close proximity to the retort chamber walls whereby the retort chamber closest to the combustion compartment is raised to the highest temperature, and the ascending retort chambers are raised to progressively lower temperatures as their distance from the combustion compartment increases; and means for disposing of spent material from the staged retort.

5. The staged retort of claim 4 wherein the means for transporting includes:

means for limiting the mixing of liquid and/or gaseous products between the retort chambers to a predetermined acceptable level;

equal pressure maintaining means in the means for limiting, for maintaining approximately equal pressure in all retort chambers; and means for decreasing pressure in the means for separately withdrawing pyrolysis products, to a pressure less than the pressure in each corresponding retort chamber, for inducing flow of the pyrolysis products through the means for separately withdrawing and for limiting the mixing of pyrolysis products between the retort chambers.

6. The staged retort of claim 4 wherein the means for raising gas temperature includes a gas heat exchanger subjected to the heat within the staged retort, and through which the gas flows.

7. The staged retort of claim 4 wherein the combustion compartment includes:

a combustion tube into which heated carbonaceous material is introduced;

said combustion tube having one or more lower apertures on its underside through which an oxygen carrying gas is passed causing combustion of the heated carbonaceous material;

said combustion tube having one or more upper apertures through which hot flue gas created by combustion exits;

means for removing the burned residue of the carbonaceous material from the combustion tube;

a plenum chamber below the combustion tube and sealed thereto so that the oxygen carrying gas must pass through the lower apertures of the combustion tube; and, means for inserting the oxygen carrying gas into the plenum chamber.

* * * * *